US006554354B1

(12) United States Patent
Hoffman et al.

(10) Patent No.: US 6,554,354 B1
(45) Date of Patent: Apr. 29, 2003

(54) SEATING UNIT WITH REMOVABLE TABLE AND MOUNTING BRACKET THEREFOR

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 09/660,640

(22) Filed: Sep. 13, 2000

(51) Int. Cl.[7] ..... A47B 39/00

(52) U.S. Cl. ..... 297/145; 297/170; 297/188.2; 108/42; 248/118

(58) Field of Search ..... 297/135, 144, 297/145, 148, 149, 150, 153, 154, 155, 128, 188.2, 127, 188.15, 411.26, 411.23, 411.45, 170; 108/42, 152, 33; 248/118, 188.3, 295.11, 298.1

(56) References Cited

U.S. PATENT DOCUMENTS 1,888,525 A * 11/1932 Callaway et al. ..... 297/145
2,535,112 A * 12/1950 Woody
2,605,155 A * 7/1952 Lewis
3,086,226 A * 4/1963 Kyser et al.
3,632,161 A * 1/1972 Arfaras et al. ..... 297/145
4,455,008 A * 6/1984 Mackew ..... 248/447.2
4,834,449 A * 5/1989 Engelman ..... 297/150 X
5,035,464 A * 7/1991 Spallholtz ..... 297/144
5,050,929 A * 9/1991 Gueringer et al. ..... 297/145
5,630,642 A * 5/1997 Grimmett et al. ..... 297/145
5,765,911 A * 6/1998 Sorenson ..... 297/173

* cited by examiner

*Primary Examiner*—Peter M. Cuomo
*Assistant Examiner*—Stephen Vu
(74) *Attorney, Agent, or Firm*—Myers Bigel Sibley & Sajovec

(57) ABSTRACT

A seating unit comprises: an armrest having an inwardly facing surface that includes an aperture; a table having a support surface mounted on and above a mounting post; and a mounting bracket mounted within the armrest. The mounting bracket is configured to receive the mounting post through the aperture in the armrest and to detachably secure the mounting post such that the support surface is generally horizontally disposed. In this configuration, the seating unit can provide a table-type surface in a convenient location for an occupant of the seating unit, yet the table can be removed when its presence is undesirable.

28 Claims, 10 Drawing Sheets

SEATING UNIT WITH REMOVABLE TABLE AND MOUNTING BRACKET THEREFOR

FIELD OF THE INVENTION

The present invention relates generally to furniture, and relates more particularly to seating units.

BACKGROUND OF THE INVENTION

Many residences today include a seating unit, such as a sofa or chair, near which is placed a table, such as a coffee table or end table. Coffee tables can provide a surface for supporting food and drink and displaying decorative items or reading materials, and can also by themselves improve the appearance of the room. Likewise, end tables can provide a support surface for these items as well as reading lamps, telephones and the like.

One of the drawbacks of the support surfaces provided by coffee tables and end tables is the inconvenient location of the support surface relative to an occupant of the seating unit. For example, if the occupant rests a plate of food or a drinking glass on the coffee table, he must lean forward from a seated position to retrieve it; this is somewhat awkward, particularly with seating units that employ deep, soft cushions. If the occupant wishes to eat from the plate or drink from the glass, he has two options. First, he can lean over the table while eating or drinking, which can be even more awkward then simply leaning over the table to retrieve the plate. Second, the occupant can grasp the plate and carefully balance it as it travels with him to the seated position, after which he must support the plate as he eats. Either of these options can be unsatisfactory, as the risk of the occupant spilling food or drink onto the table, the underlining floor (which is often carpeted), or the seating unit itself is significant.

The situation is typically no better with an end table; the occupant must twist to retrieve the plate or glass from the end table and either consume in this awkward twisted position or balance the plate or glass as it travels and resides above the seating unit. Often the difficulty is exasperated by the presence of an armrest on the end of the seating unit that the occupant must negotiate.

The underlying cause of these difficulties is the position of the support surface relative to the seating unit. On coffee tables, the support surface is too low and too far forward for convenient access to the occupant of the seating unit. On end tables, the support surface is placed beside, rather than directly in front of, the seated occupant. However, furniture styles dictate that coffee tables and end tables provide support surfaces in these locations.

One common solution to this problem is the use of a portable "TV tray" that can be placed in front of the seating unit at a reasonably comfortable height and location. However, typically such TV trays are stored at locations that are some distance away from the seating unit, and are not, therefore, particularly convenient. Also, because these units are intended to be portable, they are often rather light and can tip easily when jostled by an occupant of the seating unit.

Another approach to this problem is offered through the use of table surfaces that store within the armrest of a seating unit. In one such example, the upholstered top surface of the armrest opens to expose an internal cavity in the armrest within which is stored a tray. This table surface, which is mounted within the cavity, rises above the armrest and pivots to provide a support surface immediately in front of an occupant of the seating unit. Another approach has been to include a table surface that emerges from the front of the armrest to pivot into position in front of an occupant.

Each of these approaches has certain drawbacks. First, including the mechanisms that enable the table surface to fold into position from the armrest cavity can add both cost and weight to the seating unit. Second, in each instance access to the table surface requires that some portion of the armrest be removable. As such, this can adversely impact the appearance of the seating unit, and may be appropriate only with certain furniture styles.

SUMMARY OF THE INVENTION

A seating unit of the present invention can address some of the aforementioned shortcomings by providing a support surface that can be easily accessed and used with a wide variety of furniture styles. A seating unit of the present invention comprises: an armrest having an aperture (preferably located in an inward surface of the armrest); a table having a support surface mounted on and above a mounting post; and a mounting bracket mounted within the armrest. The mounting bracket is configured to receive the mounting post through the aperture in the armrest and to detachably secure the mounting post such that the support surface is generally horizontally disposed. In this configuration, a seating unit of the present invention can provide a table-type surface in a convenient location for an occupant of the seating unit, yet the table can be removed when its presence is undesirable.

In one embodiment of the present invention, the aperture in the armrest is positioned below the upper support surface of a seat cushion, thereby hiding the aperture from view when the seating unit is unoccupied. Preferably, the seat cushion compresses sufficiently under the weight of an occupant to expose the aperture, with the result that the table can be inserted easily into the aperture for mounting.

The mounting bracket preferably comprises: a mounting panel adapted for mounting to a front stump of the armrest; an inward panel that extends rearwardly from the mounting panel that includes an entry aperture; and a plurality of guide members attached to and extending rearwardly from the mounting panel. The guide members are configured and arranged to receive and detachably secure the mounting post of a removable table, as the inward panel aperture and the guide members define a travel path for the mounting post.

DETAILED DESCRIPTION OF THE INVENTION

The present invention now will be described more fully hereinafter with reference to the accompanying drawings, in which preferred embodiments of the invention are shown and described. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like components throughout. Some dimensions and thicknesses may be exaggerated for clarity.

Figure 1:
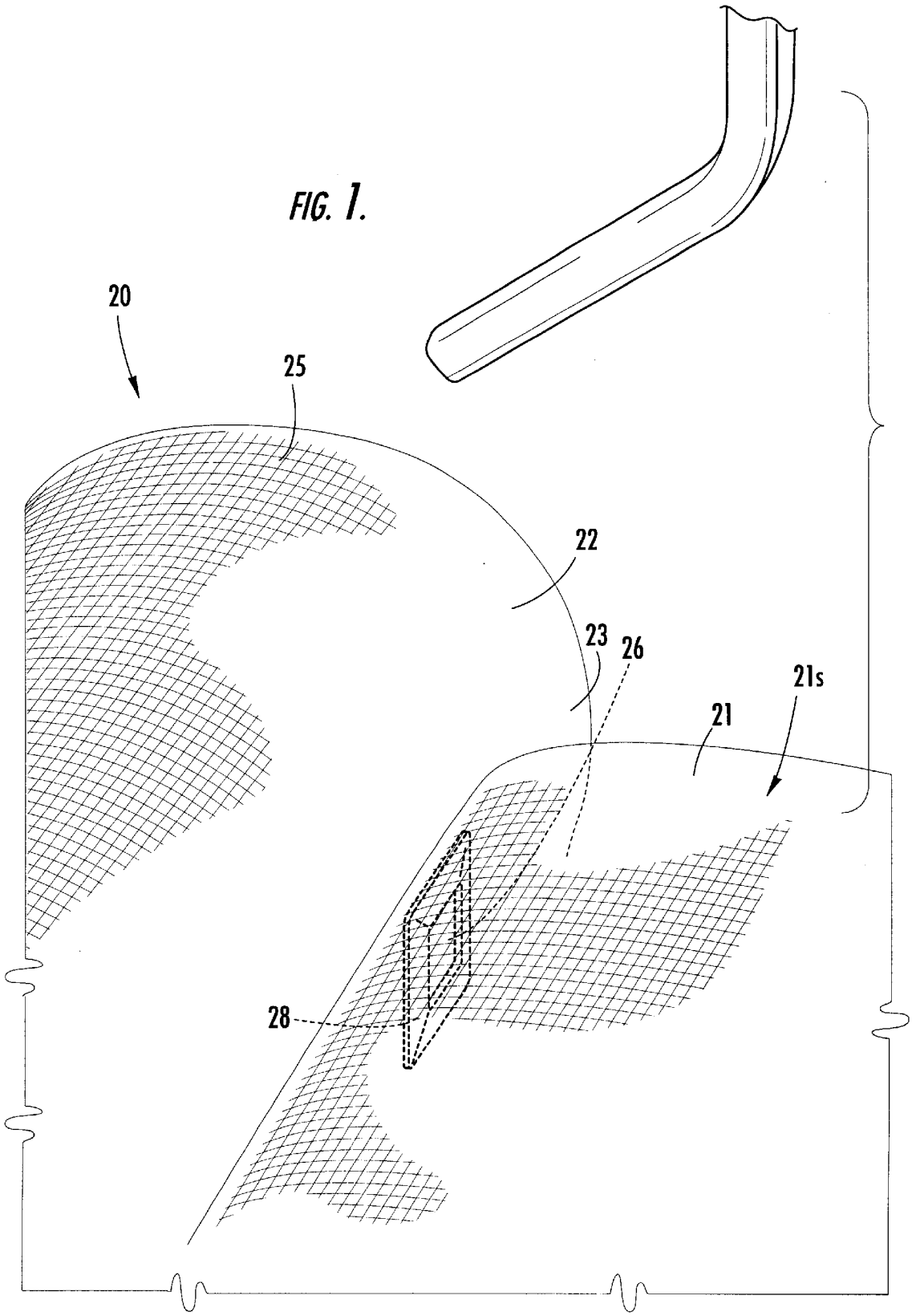
FIG. 1 is a partial rear perspective view of a seating unit and removable table of the present invention with the seat cushion in place.

Referring now to FIG. 1, a chair, designated broadly at 20, is illustrated therein. FIG. 1 illustrates one armrest 22 of the chair 20 along with a removable seat cushion 21 having an upper surface 21*s* for supporting a seated occupant. The armrest 22 includes a front stump 24 (see FIG. 2), typically formed of wood, that forms the front face of the armrest 22 (ordinarily, the front surface of the front stump 24 is covered with upholstery 25, as is the remainder of the armrest 22). The armrest 22 also includes an inward surface 23 that faces the seat cushion 21. (As used herein, "inward", "inner" and derivatives thereof refer to the horizontal direction extending from the armrest toward the cushion; "outward", "outer" and derivatives thereof refer to the direction opposite the inward direction. Together, the inward and outward directions define a "lateral" axis. A "fore-and-aft" axis is horizontally disposed perpendicular to the lateral axis).

Those skilled in this art will recognize that, although the chair 20 is illustrated herein, the present invention is suitable for a variety of different seating units, including chairs, sofas, loveseats, sectional and modular sofas, and the like. Also, skilled artisans will recognize that the present invention may be used with both conventional stationary furniture and "motion" furniture, which includes, inter alia, reclining seating units and sofas that include foldable beds. Irrespective of the type of seating unit employed with the present invention, the seating unit should include an armrest having an inward face that faces the occupant support surface (as exemplified by the upper surface 21*s* of the seat cushion 21).

Figure 1A:
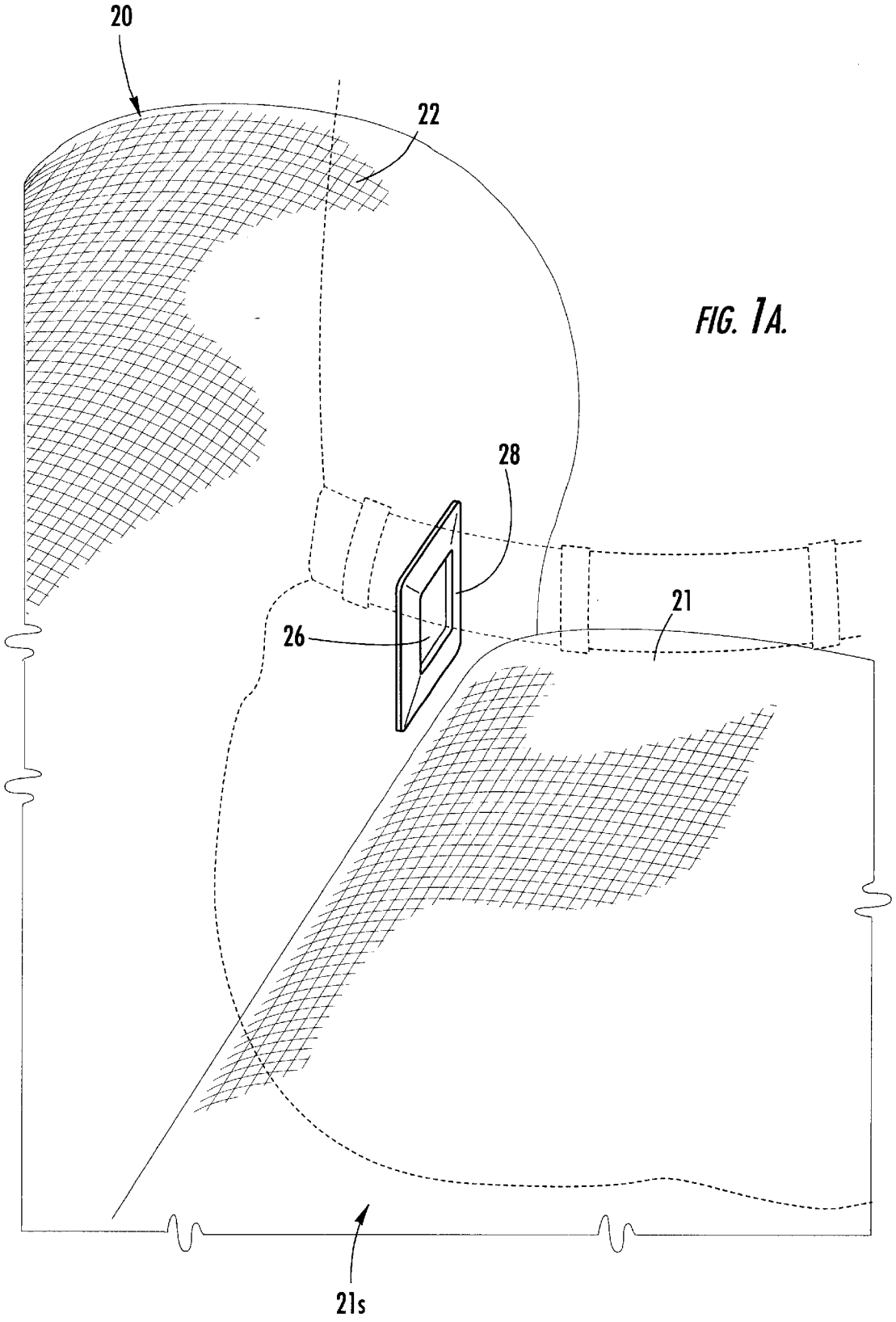
FIG. 1A is a partial rear view of the seating unit and table of FIG. 1 with an occupant seated therein.

A mounting aperture 26 is located in a preferred location in the inward surface 23 of the armrest 22 (although it can be located on the outer or front surfaces of the armrest). Illustratively and preferably, the aperture 26 is located below the upper surface 21*s* of the seat cushion 21, such that, when the seat cushion 21 is relaxed (i.e., that portion of the chair 20 is unoccupied), the upper surface 21*s* of the seat cushion 21 is at a higher elevation then the aperture 26. When the aperture 26 is so located, it is hidden from view when the seat cushion 21 is unoccupied and only becomes visible when the seat cushion 21 deforms downwardly under the weight of an occupant (see FIG. 1A). Preferably, the aperture 26 is positioned between about 0.5 and 2.0 inches below the undeformed upper surface 21*s*, and between about 1.0 and 8.0 inches from the front edge of the chair 20. A cap 28, typically plastic, is mounted upon the inward face 23 surrounding the aperture 26 to protect it from wear and abuse.

Referring now to FIGS. 2 through 5, a mounting bracket 30 is mounted to the front stump 24 outwardly of the inward face 23 of the armrest 22 within the cavity of armrest 22. Illustratively and preferably, the mounting bracket 30 includes a front mounting panel 32 that is mounted against the rear face of the front stump 24 via threaded fasteners 32*a*. The mounting bracket 30 also includes an inward mounting panel 34 that extends rearwardly from the inward edge of the front panel 32 and is disposed outwardly of and against the inward face 23 of the armrest 22. Although not employed for mounting in the illustrated embodiment, the forward mounting panel 34 may be employed to mount the mounting bracket 30 to a suitable surface within the armrest cavity. The inward mounting panel 34 includes an entry aperture 36 that is positioned slightly below the aperture 26 and is aligned with the aperture 26 along a vertical plane V (FIG. 3) that is parallel to the lateral axis.

A pair of inward rollers 38*a*, 38*b* are mounted to the rear surface of the front mounting panel 32 and extend rearwardly therefrom. Each of the inward rollers 38*a*, 38*b* is free to rotate about its axis, which is parallel to the fore-and-aft axis. The gap 38*a* between the inward rollers 38*a*, 38*b* is approximately equal to the vertical dimension of the entry aperture 36. An angled guide 42 is mounted to the rear surface of the front mounting panel 32. The guide 42 includes a rearwardly-extending flange 43 that slopes downwardly, outwardly and tangentially from the circumferential surface of the inward roller 38*a*. A pair of lateral rollers 40*a*, 40*b* are also rotatably mounted to the rear surface of the front mounting panel 32 and extend rearwardly therefrom. The lateral rollers 40*a*, 40*b* form a gap 40*c* therebetween. A stop pin 44 is mounted to and extends rearwardly from the rear surface of the front mounting panel 32 and is located just below the lateral roller 40*a*.

Figures 4, 4A:
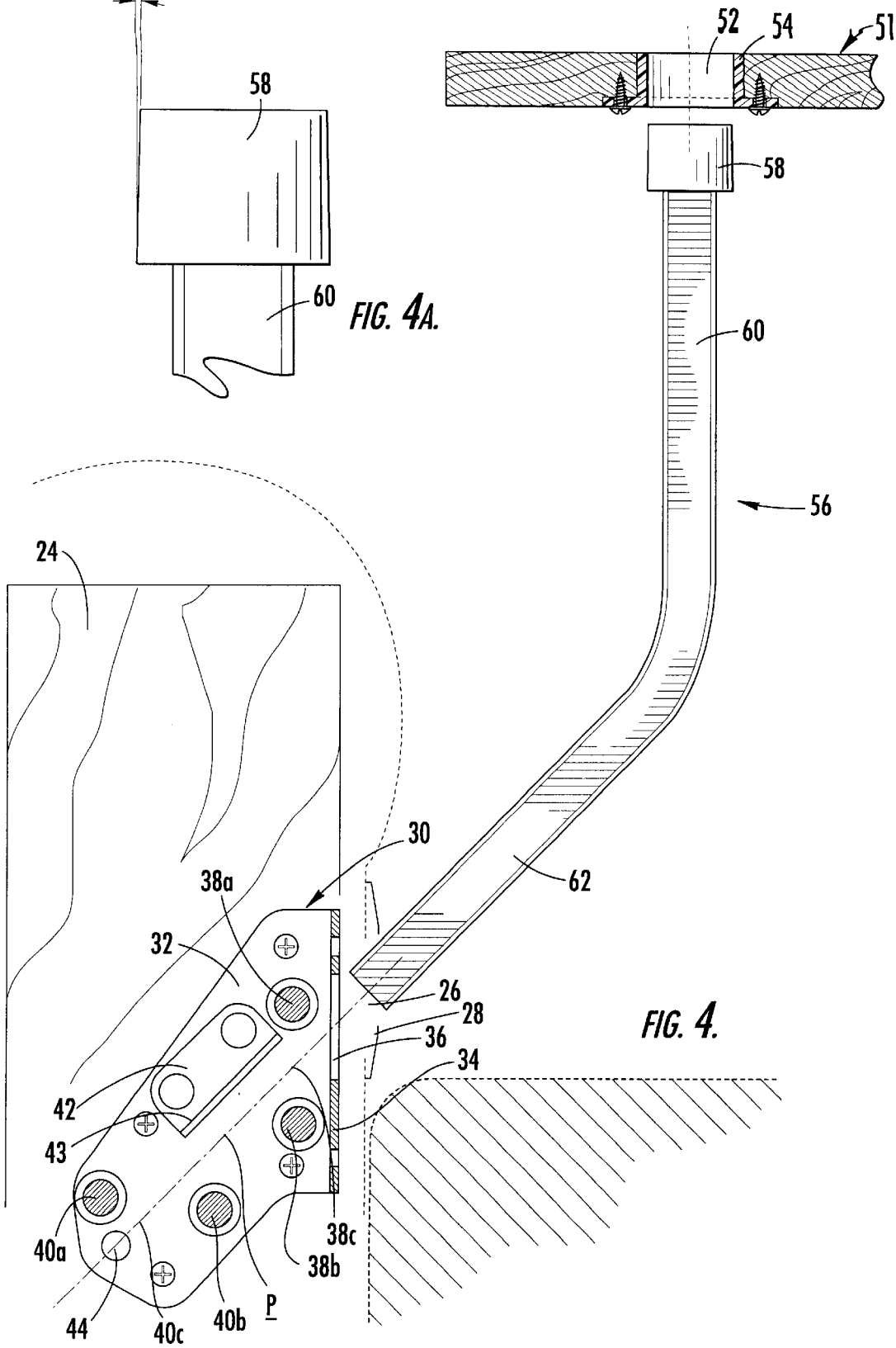
FIG. 4 is a cutaway rear view of the removable table shown in FIG. 1 with the table removed from the mounting bracket.
FIG. 4A is a greatly enlarged partial view of the post and knob of the table of FIG. 4.

As can be seen from FIG. 4, the gap 38*c*, the rear flange 43, and the gap 40*c* define a linear travel path P. The travel path P extends from the entry aperture 36 to the stop pin 44 within the aforementioned plane V (of course, the travel path need not be parallel to this plane). Those skilled in this art will appreciate that components other than the illustrated rollers and guide flange may also be employed to define the travel path P, including projections of other configurations, rings, bushing brackets, clips, and the like.

Figure 2:
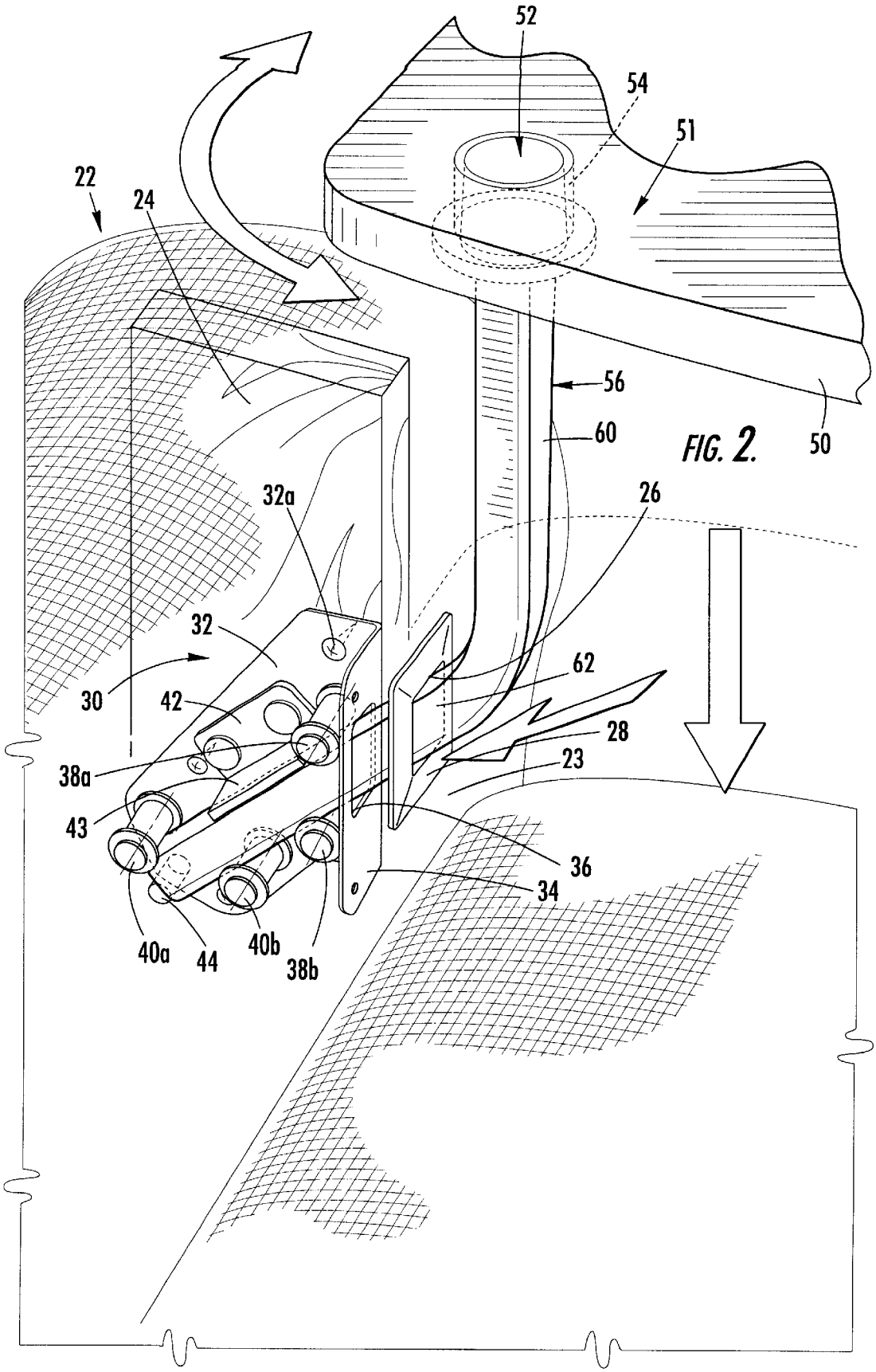
FIG. 2 is a partial rear perspective view of the seating unit of FIG. 1 illustrating the removable table inserted into a mounting bracket with the seat cushion removed for clarity.

Referring still to FIGS. 2 through 5, a removable table 50 can be removably mounted to the chair 20 via a mounting post 56. The table 50, which provides a support surface 51, includes a mounting aperture 52 that houses a hollow bushing 54. The bushing 54 receives a knob 58 located at the upper end of the mounting post 56. Illustratively, the knob 58 is slightly tapered at an angle from its lower to its upper end, as is the bushing 54. This configuration enables the table 50 to be secured and removed from the mounting post 56, yet still rotate relative thereto about a vertical axis A (as shown in FIG. 2). Of course, the table 50 may be permanently secured to the mounting post 56; for example, it may be fixed thereto, or may be pivotally attached such that the mounting post 56 folds to a position adjacent to and parallel with the table 50.

The mounting post 56 includes a vertical segment 60, which is attached to and extends downwardly from the knob 58, and an angled segment 62, which merges with the lower end of the vertical segment 60 and extends downwardly and outwardly therefrom. Preferably, the angled segment 62 forms an angle of between about 30 and 60 degrees with the vertical segment 60. Illustratively, the mounting post 56 is formed of square tubing, the cross-section of which can improve interaction between the angled segment and the mounting bracket 30, although those skilled in this art will understand that other configurations and cross-sections for the mounting post 56 may also be suitable for the present invention.

Figure 3:
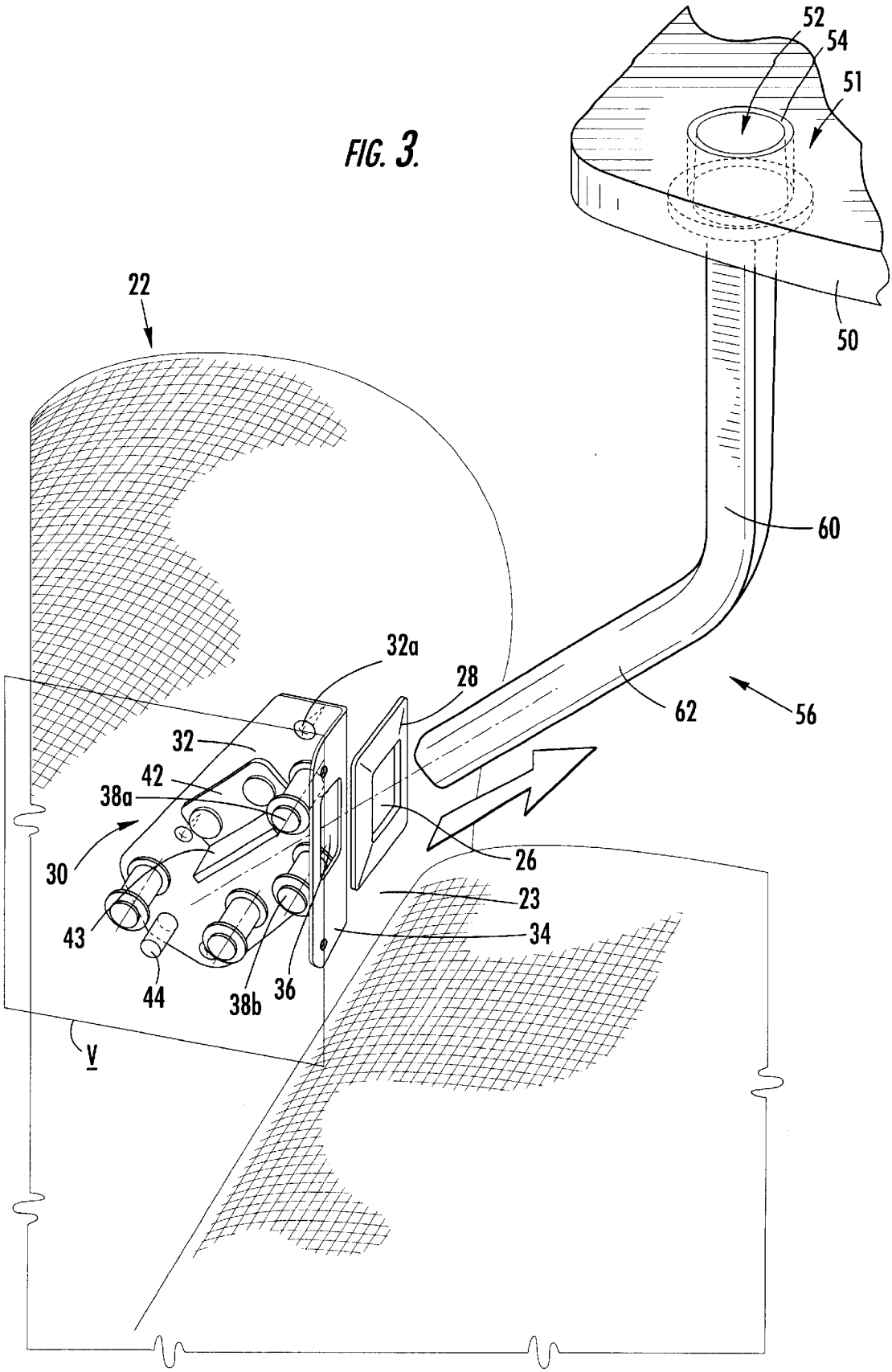
FIG. 3 is a partial rear perspective view of the seating unit of FIG. 1 illustrating the table removed from the mounting bracket.
Figure 5:
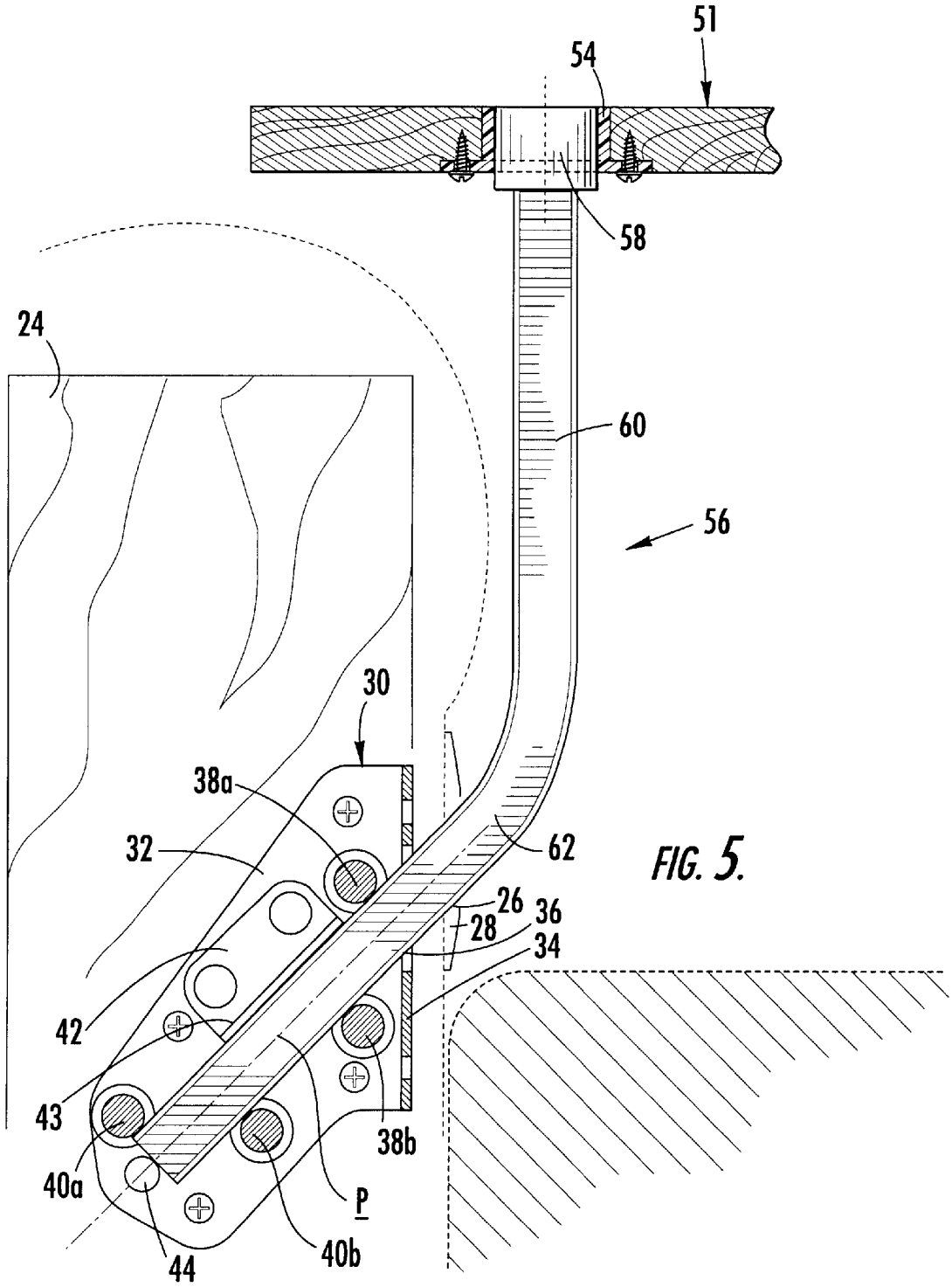
FIG. 5 is a cutaway rear view of the seating unit of FIG. 1 with the removable table inserted into the mounting bracket with the seat cushion illustrated in phantom line.
Figure 6:
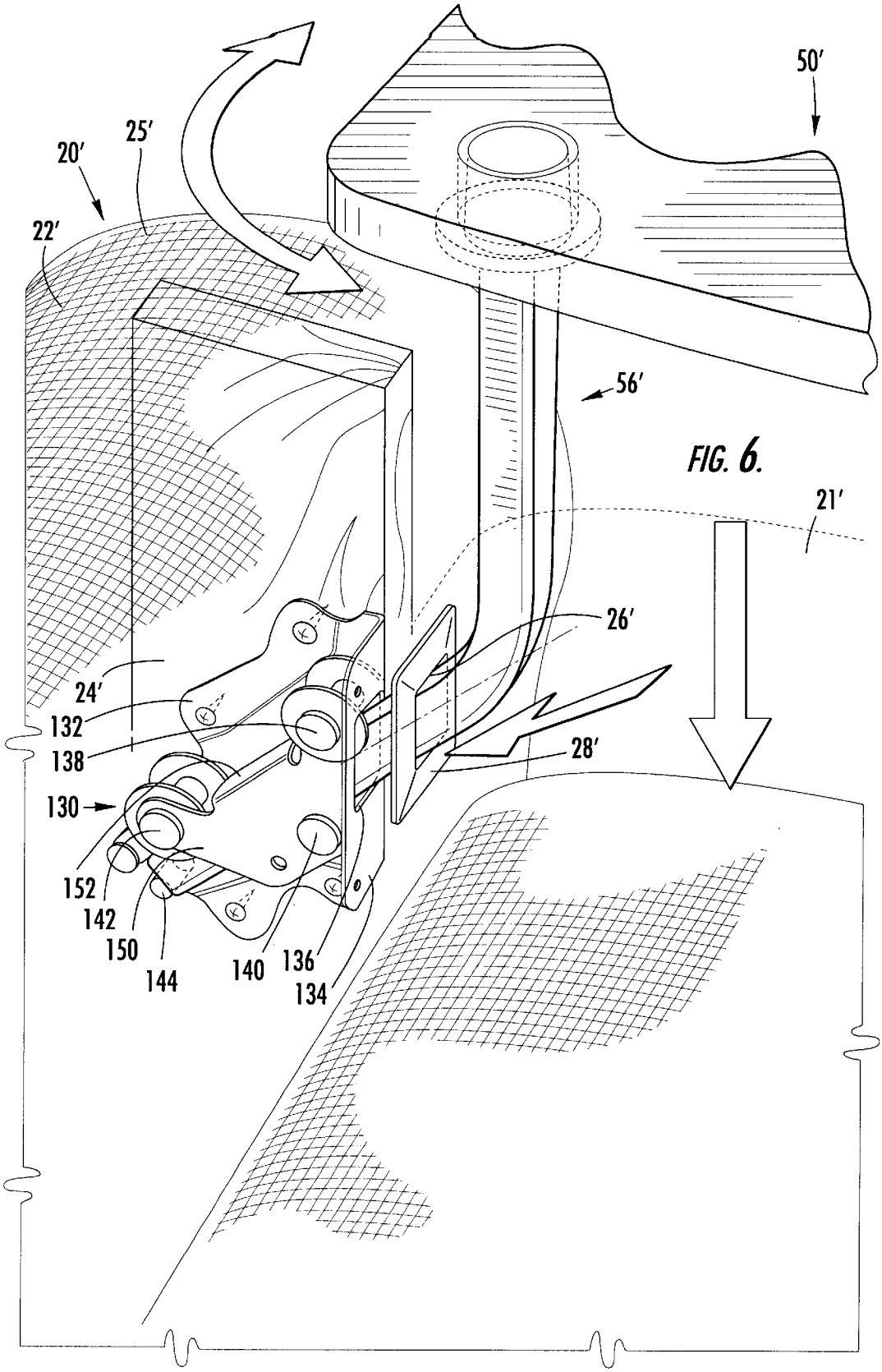
FIG. 6 is a partial rear perspective view of another embodiment of the seating unit and removable table of the present invention with the seat cushion illustrated in phantom line.
Figure 7:
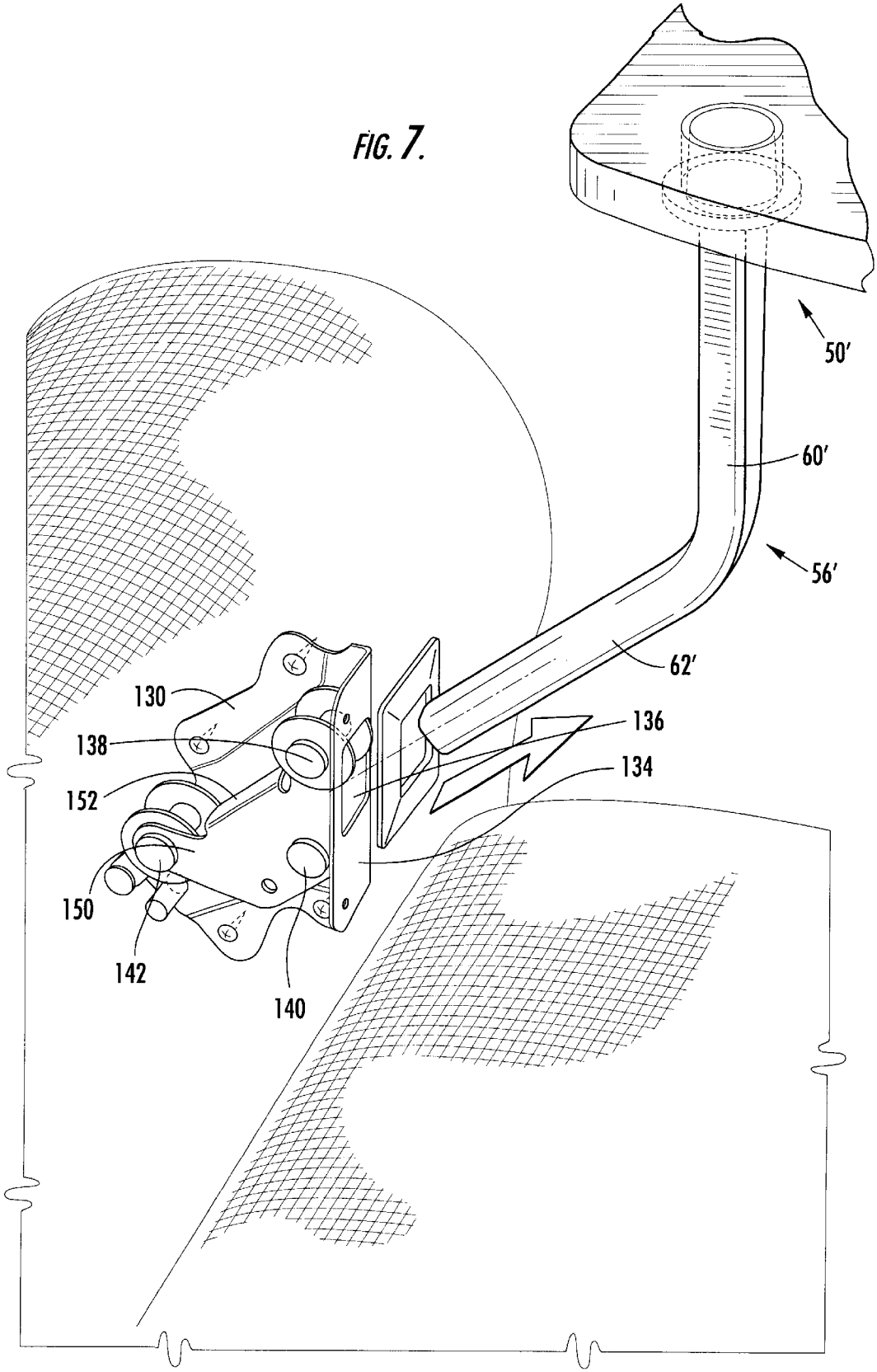
FIG. 7 is a partial rear perspective view of the seating unit and removable table of FIG. 6 with the table removed from the mounting bracket and the seat cushion removed for clarity.
Figure 8:
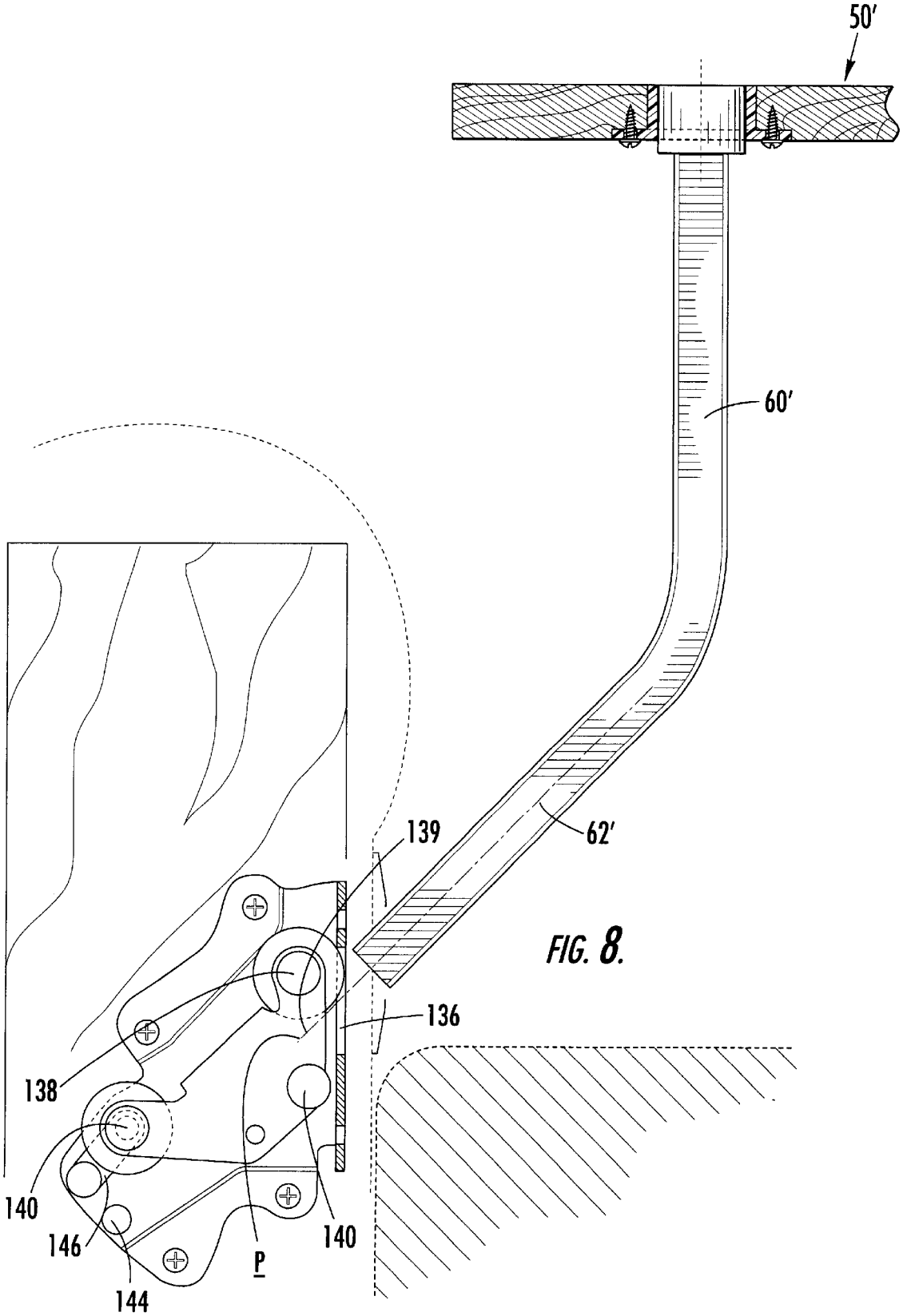
FIG. 8 is a cutaway rear view of the seating unit and removable table of FIG. 6 with the table removed from the mounting bracket.
Figure 9:
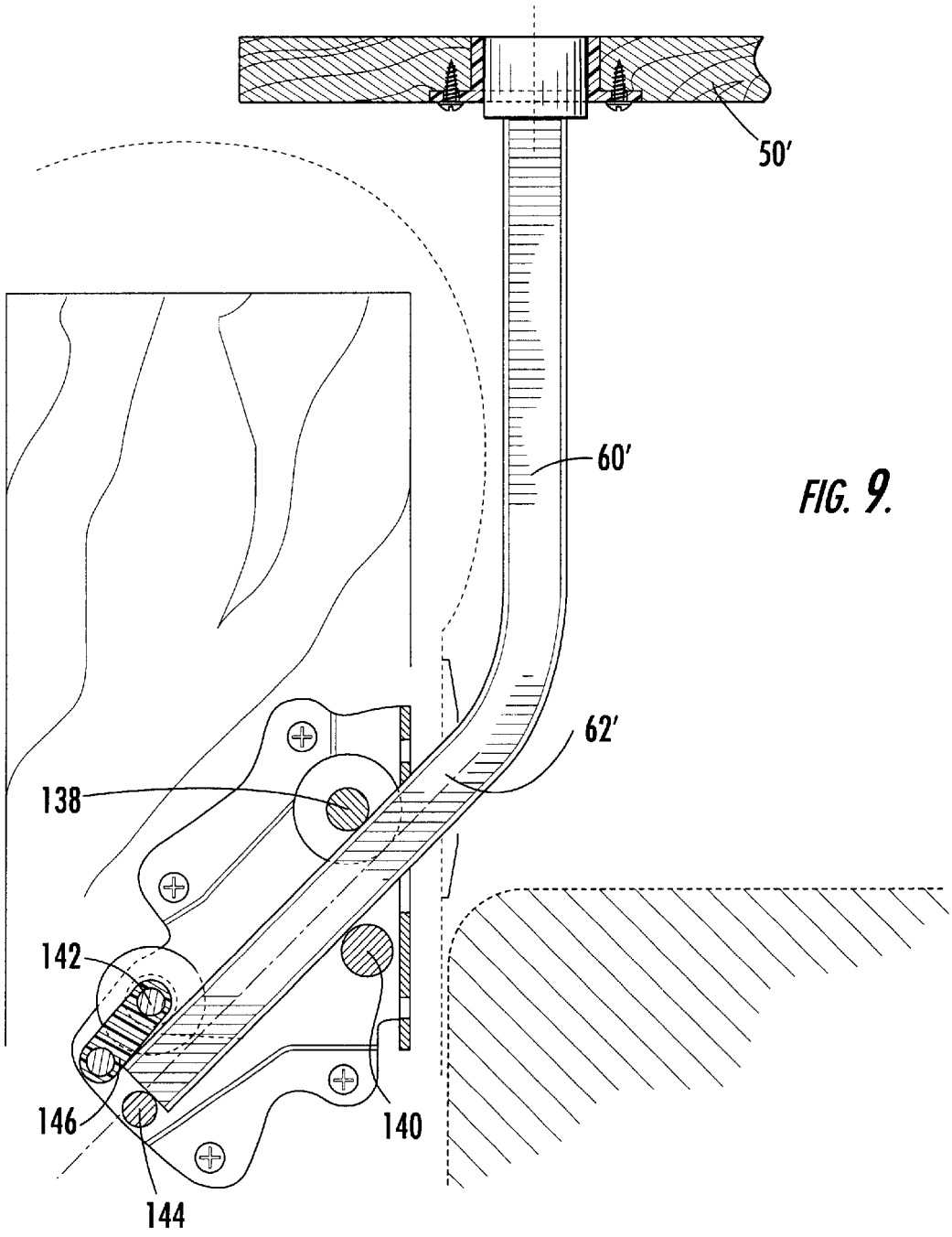
FIG. 9 is a cutaway rear view of the seating unit and table of FIG. 6 with the table inserted into the mounting bracket.

Still referring to FIGS. 2 through 5, the operation of the removable table 50 is illustrated therein. Initially, the table 50 and mounting post 56 are detached from the chair 20 (FIGS. 3 and 4). The table 50 can be mounted to the chair 20 by inserting the angled segment 62 of the mounting post 56 through the aperture 26 in the inward surface 23 of the armrest 22, then through the entry aperture 36 of the mounting bracket 30, then along the travel path P defined by the gap 38*c,* the flange 43, and the gap 40*c*. Movement of the mounting post 56 ceases when the lower end of the angled segment 62 strikes the stop pin 44 (FIGS. 2 and 5). Insertion of the angled segment 62 is facilitated by the rollers 38*a,* 38*b,* 40*a,* 40*b,* as the rotating action thereof can reduce the friction experienced by the angled segment 62 during insertion. Also, the flange 43 as close to arm as possible acts as a positioning guide to prevent the lower end of the angled segment 62 from veering from the travel path P. Insertion of the table 50 positions the support surface 51 directly in front of a seated occupant (preferably at a height of about 20 and 35 inches above the underlying surface). The table 50 can be detached simply by drawing the angled segment 62 of the mounting post 56 along the travel path P and out of the aperture 26.

Notably, the table 50 can be inserted for use when an occupant is seated in the chair 50. The seat cushion 21 compresses under the weight of the occupant, which exposes the aperture 26 so that it can receive the mounting post 56. As such, the table 50 and mounting post 56 can be kept near the chair 50 when the chair 50 is unoccupied or when the occupant does not wish to use the table 50, then can be conveniently reached, grasped and inserted without the occupant needing to leave the chair 20. In one embodiment, the chair 20 can include a pocket or pouch (for example, located on the lower front face of the chair 20 below the seat or on the outer surface of the armrest 22) within which the table 50 and mounting post 56 can be stored during periods of non-use.

Also, table 50 may be configured to serve additional functions besides a support surface. For example, the table 50 may include cut-out areas that serve as drink holders. Also, the table 50 may have an underlying drawer that can store writing instruments, paper, stamps, and the like, or may include a foldable reading lamp. Further, the table 50 may include a high-friction area that can serve as a "mouse pad" for computer use. Those skilled in this art will be able to envision other functions for which the table 50 may be suitable. In fact, an owner of the chair 20 may prefer to have at his disposal multiple tables 50, each of which serves one or more different functions.

Another embodiment of the present invention is shown in FIGS. 6 through 9, in which a chair 20' is illustrated. The seat cushion 21', armrest 22', front stump 24', upholstery 25', aperture 26' and cap 28' are identical to those shown in FIGS. 2 through 5, as are the table 50' and the mounting post 56' (with its vertical segment 60' and its angled segment 62'); however, in this embodiment a mounting bracket 130 is configured differently than the mounting bracket 30 of the embodiment of FIGS. 2 through 5. The mounting bracket 130 includes a front mounting panel 132 mounted to the rear surface of the front stump 24' and an inward mounting panel 134 that is mounted to an outward surface of the armrest 22' with an entry aperture 136. An inward roller 138 is mounted just below and outwardly of the upper edge of the entry aperture 136. An inward guide pin 140 is mounted below and outwardly of the lower edge of the entry aperture 136. A cover 150 is mounted to and rearwardly of the mounting bracket 130 and includes a guide panel 152 located in essentially the same position as the rear flange 43 of the embodiment of FIGS. 2 through 5. An outward roller 142 is mounted outwardly from and below the guide panel 152, and a stop pin 144 is mounted below the outward roller 142. Thus, a travel path P' is defined by (a) the gap 139 between the inward roller 138 and the inward guide pin 140, (b) the guide panel 152, and (c) the lower end of the outward roller 142.

A stabilizing shim 146 is fixed to the axle of the lateral roller 142 and extends downwardly and outwardly therefrom. Notably, the stabilizing shim 146 extends downwardly and outwardly at a slightly steeper angle (relative to the underlying surface) than the travel path P'. As a result, as the angled segment 62' of the mounting post 56' strikes the stabilizing shim 146, it is forced downwardly by the lower surface of the stabilizing shim 146. Consequently, the mounting post 56' (and in turn the table 50') is stabilized from movement in the lateral direction that otherwise may be possible due slight mismatches in dimensions between the rollers 138, 142, the guide pin 140, and the guide panel 152.

Those skilled in this art will recognize that other structures and components may be substituted for the shim 146 and have similar stabilizing effect. For example, a shim may be positioned below the travel path P' and have a slightly shallower angle than the travel path P'. Alternatively, the stop pin 144 may be replaced with an open-ended pocket or square bushing that receives the end of the angled segment 62'. Virtually any structure that can limit the movement of the end of the angled segment 62' perpendicular to the travel path P may be suitable for stabilizing the table 50' of the present invention.

The foregoing embodiments are illustrative of the present invention and are not to be construed as limiting thereof, the invention being defined by the claims that follow. Although exemplary embodiments of this invention have been described, those skilled in the art will readily appreciate of any modifications are possible in the exemplary embodiments without materially departing from the novel teachings and advantages of this invention.

What is claimed is:

1. A seating unit, comprising:

an armrest having an inwardly facing surface, said inwardly facing surface including an aperture;

a table comprising a support surface mounted on and above a mounting post; and a mounting bracket mounted within said armrest, said mounting bracket configured to receive said mounting post through said aperture and detachably secure said mounting post such that said mounting post extends inwardly when emerging from said aperture to connect with said support surface and said support surface is generally horizontally disposed;

wherein the mounting bracket further comprises a plurality of guide members that define a travel path of the mounting post.

2. The seating unit defined in claim 1, wherein said seating unit further comprises a seat cushion having an upper support surface, and wherein said armrest aperture is positioned below said upper support surface of said cushion.

3. The seating unit defined in claim 2, wherein said armrest aperture is located between about 0.5 and 2.0 inches below said upper support surface of said cushion.

4. The seating unit defined in claim 1, wherein said mounting post comprises a vertical segment that extends downwardly from said support surface and an angled segment that extends downwardly and outwardly from said vertical segment, said angled segment being received in said mounting bracket.

5. The seating unit defined in claim 4, wherein said angled segment forms an angle of between about 30 and 60 degrees with said vertical segment.

6. The seating unit defined in claim 1, wherein said table is mounted on said mounting post such that said table is free to rotate about a substantially vertical axis.

7. The seating unit defined in claim 1, wherein said mounting post has a substantially square cross-section.

8. The seating unit defined in claim 7, wherein said mounting post comprises a vertical segment that extends downwardly from said support surface and an angled segment that extends downwardly and outwardly from said vertical segment, said angled segment being received in said mounting bracket.

9. The seating unit defined in claim 8, wherein said angled segment forms an angle of between about 30 and 60 degrees with said vertical segment.

10. A seating unit, comprising:

an armrest having a front stump and an inwardly facing surface, said inwardly facing surface including an aperture;

a table comprising a support surface mounted on and above a mounting post;

a mounting bracket mounted within said armrest to said front stump, said mounting bracket configured to receive said mounting post through said aperture and detachably secure said mounting post such that said support surface is generally horizontally disposed, said mounting bracket further comprising an inward mounting panel positioned outwardly from said armrest aperture, said inward mounting panel including an entry aperture.

11. The seating unit defined in claim 10, wherein said mounting bracket further comprises a plurality of guide members that define a travel path for said mounting post.

12. The seating unit defined in claim 11, wherein at least one of said guide members comprises a roller rotatably mounted to said mounting bracket.

13. The seating unit defined in claim 11, wherein at least one of said guide members is a flange that extends generally parallel to said travel path.

14. The seating unit defined in claim 11, wherein said mounting bracket further comprises a stop member that defines the end of said travel path.

15. The seating unit defined in claim 10, wherein said seating unit further comprises a seat cushion having an upper support surface, and wherein said armrest aperture is positioned below said upper support surface of said cushion.

16. The seating unit defined in claim 15, wherein said armrest aperture is located between about 0.5 and 2.0 inches below said upper support surface of said cushion.

17. The seating unit defined in claim 10, wherein said table is mounted on said mounting post such that said table is free to rotate about a substantially vertical axis.

18. The seating unit defined in claim 10, wherein said mounting bracket further comprises a stabilizing member that contacts said mounting post and reduces lateral movement of said table surface.

19. The seating unit defined in claim 18, wherein said stabilizing member extends at an angle that is steeper relative to an underlying surface than an angle of a travel path of the mounting post.

20. The seating unit defined in claim 10, wherein said mounting post has a substantially square cross-section.

21. A seating unit, comprising:

an armrest having an inwardly facing surface, said inwardly facing surface including an aperture;

a table comprising a support surface mounted on and above a mounting post;

a mounting bracket mounted within said armrest, said mounting bracket configured to receive said mounting post through said aperture and detachably secure said mounting post such that said support surface is generally horizontally disposed;

wherein said mounting bracket further comprises wherein said armrest further comprises a front stump, and wherein said mounting bracket is mounted to said front stump.

22. A seating unit, comprising:

an armrest having an inwardly facing surface, said inwardly facing surface including an aperture;

a table comprising a support surface mounted on and above a mounting post;

a mounting bracket mounted within said armrest, said mounting bracket configured to receive said mounting post through said aperture and detachably secure said mounting post such that said support surface is generally horizontally disposed;

wherein said mounting bracket further comprises an inward mounting panel positioned outwardly from said armrest aperture, said inward mounting panel including an entry aperture.

23. A seating unit, comprising:

an armrest having an inwardly facing surface, said inwardly facing surface including an aperture;

a table comprising a support surface mounted on and above a mounting post;

a mounting bracket mounted within said armrest, said mounting bracket configured to receive said mounting post through said aperture and detachably secure said mounting post such that said support surface is generally horizontally disposed;

wherein said mounting bracket further comprises a plurality of guide members that define a travel path for said mounting post.

24. The seating unit defined in claim 23, wherein at least one of said guide members comprises a roller rotatably mounted to said mounting bracket.

25. The seating unit defined in claim 23, wherein at least one of said guide members is a flange that extends generally parallel to said travel path.

26. The seating unit defined in claim 23, wherein said mounting bracket further comprises a stop member that defines an end of said travel path.

27. A seating unit, comprising:

an armrest having an inwardly facing surface, said inwardly facing surface including an aperture;

a table comprising a support surface mounted on and above a mounting post; a mounting bracket mounted within said armrest, said mounting bracket configured to receive said mounting post through said aperture and detachably secure said mounting post such that said support surface is generally horizontally disposed;

wherein said mounting bracket further comprises a stabilizing member that contacts said mounting post and reduces lateral movement of said table surface.

28. The seating unit defined in claim 27, wherein said stabilizing member extends at an angle that is steeper relative to an underlying surface than an angle of a travel path of the mounting post.

* * * * *